US005600857A

United States Patent [19]

Heilmann

[11] Patent Number: 5,600,857

[45] Date of Patent: Feb. 11, 1997

[54] VEHICLE FOR CARRYING A DISABLED PERSON

[76] Inventor: Steve Heilmann, 12985 McCourtney, Grass Valley, Calif. 95949

[21] Appl. No.: 336,874

[22] Filed: Nov. 9, 1994

[51] Int. Cl.[6] ..... A61G 7/08

[52] U.S. Cl. ..... 5/81.1 R; 5/86.1

[58] Field of Search ..... 5/81.1, 86.1; 280/250.1

[56] References Cited

U.S. PATENT DOCUMENTS

| | | | |
|---|---|---|---|
| 3,037,570 | 6/1962 | Olson | 180/6.5 |
| 3,976,155 | 8/1976 | Esch | 280/32.5 |
| 4,394,049 | 7/1983 | Ward | 297/439 |
| 4,397,374 | 8/1983 | Rumage et al. | 182/129 |
| 4,435,863 | 3/1984 | Lerich | 5/81.1 |
| 4,510,633 | 4/1985 | Thorne | 5/81.1 |
| 4,809,804 | 3/1989 | Houston et al. | 5/81.1 |
| 4,832,407 | 5/1989 | Serber | 297/437 |
| 4,863,178 | 9/1989 | Friesen | 280/32.6 |
| 5,001,789 | 3/1991 | Schoenberger | 5/81.1 |
| 5,233,708 | 8/1993 | Winston, Sr. | 5/81.1 |

OTHER PUBLICATIONS

Advertisement pp. 47, 39, 34, Mainstream Dec. 1993/Jan. 1994.

*Primary Examiner*—Michael J. Milano
*Attorney, Agent, or Firm*—Bielen, Peterson & Lampe

[57] ABSTRACT

A vehicle for carrying a disabled person along a surface utilizing a base member and a torso support linked to the base member. The torso support extends outwardly from the base member at a particular distance and angle. A thigh support is positioned intermediate the base member and the torso support. The thigh support includes a first portion and an opposed second portion which are capable of constraining the thigh area of the user. The combination of the torso support and thigh support maintains a kneeling position of the user which allows the user to perform work while employing the vehicle. Transporting means connected to the base member permits movement of the base member relative to a surface.

11 Claims, 5 Drawing Sheets

VEHICLE FOR CARRYING A DISABLED PERSON

BACKGROUND OF THE INVENTION

Many disabled persons use wheelchairs to travel from one place to another and to serve as a platform in order to accomplish work tasks, Unfortunately, constant pressure on the buttocks area of the users causes decubitus sores which require medical treatment. Certain support frames have been devised to place a disabled person in a standing position in order to eliminate the disadvantages of a wheelchair, prior discussed. For example, standing frames such as the Grandstand manufactured by Prime Engineering of Fresno, California, the Lifestand manufactured by L.D.C. Corporation of Folcroft, Pa., and a similar device manufactured by Altimate Medical, Inc., are exemplar of such devices. Although relieving pressure on the buttocks area, the standing frames heretofore described can only be employed for a limited time period before the user tires.

Many support frames have been devised to perform work which are not necessarily intended to be used by disabled persons. For example, U.S. Pat. No. 4,863,178 shows a movable support frame which permits a mechanic to stand on a platform and rest their mid-section on a cushion in order to work on items below the cushion.

U.S. Pat. No. 4,397,374 includes a T-shaped mobile frame with a standing platform and a chest support platform which may be used together to permit the mechanic to work on an engine compartment.

U.S. Pat. Nos. 3,037,570 and 4,832,407 show seats which are used in conjunction with chest supports to permit the user to remain in a sitting position and leaned forward to perform work beyond the chest support area.

U.S. Pat. Nos. 3,976,155 and 4,394,049 depict kneeling platforms used in conjunction with chest supports and work platforms for gardening and tiling.

A vehicle for carrying a disabled person in a kneeling position in order to perform work tasks would be a notable advance in the medical field.

SUMMARY OF THE INVENTION

In accordance with the present invention a novel and useful vehicle for carrying disabled persons along a surface is herein provided.

The vehicle includes as one of its elements, a base member linked to transporting means for permitting the base member to move along a surface. The transporting means may take the form of wheels, skids, skis, and the like. The base member may also be formed of any rigid or semi-rigid material and include a padded surface to permit the person using the vehicle to kneel on the same.

A torso support is also provided for in the present invention and is connected or linked to the base member. The torso support extends upwardly and outwardly from the base member and may be provided with adjustment means for determining the particular angle of orientation relative to the base member. The torso support may be constructed with a padded surface to render comfort to the chest area of the user.

The vehicle of the present invention is also provided with a thigh support which is positioned intermediate the base member and the torso support. The thigh support includes a first portion and an opposing second portion which are intended to constrain the thigh of the user and maintain a comfortable kneeling position of the user of the vehicle. The thigh support may be adjustably positioned relative to the base member and may be rotated into position against the thigh of the user.

Transporting means may be provided with an axle extending transversely relative to the base member. A pair of wheels in certain instances may be rotatably connected to the axle and sized to allow manual turning of the same by the disabled person resting on the torso support. In certain embodiments, a caster may also be employed beneath the base member and spaced from the pair of wheels to form a tricycle transporting means.

A tray may also be found in the present invention and extend from a pair of uprights which connect the base member to the torso support. The tray would extend horizontally at a level lower to the surface than the torso support in order to permit the user of the vehicle to conveniently access the tray during the performance of work tasks.

It may be apparent that a novel and useful vehicle for carrying a disabled person along a surface has been herein described.

It is therefore an object of the present invention to provide a vehicle for carrying a disabled person which easily and comfortably supports a disabled person in an upright kneeling position in order to perform work tasks.

Another object of the present invention is to provide a vehicle for carrying a disabled person which includes transporting means that is manually manipulated by the user, such as a pair of wheels located along an axle.

Yet another object of the present invention is to provide a vehicle for carrying a disabled person which eliminates the need for the disabled person to assume a sitting position and, thus, avoids the development of sores on the buttocks area.

Yet another object of the present invention is to provide a vehicle for carrying a disabled person which easily manufactured and transported to a place of work.

The invention possesses other objects and advantages especially as concerns particular characteristics and features thereof which will become apparent as the specification continues.

For a better understanding of the invention reference is made to the following detailed description of the preferred embodiments thereof which should be compared to the drawings heretofore described.

DETAILED DESCRIPTION OF THE PREFERRED EMBODIMENTS

Various aspects of the present invention will evolve from the following detailed description of the preferred embodiments thereof which should be taken in conjunction with the prior described drawings.

Figure 1:
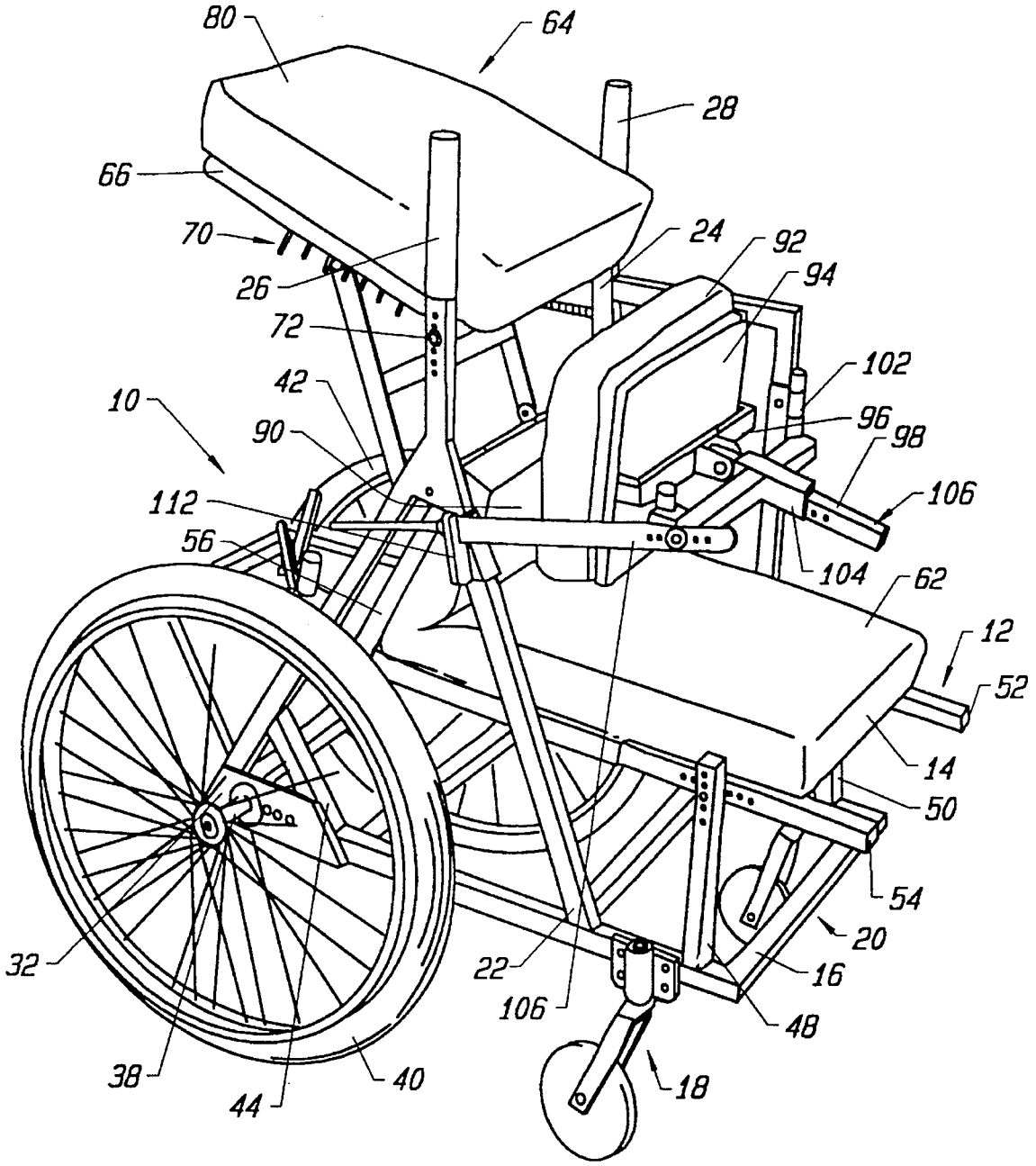
FIG. 1 is a top left perspective view of the vehicle of the present invention.
Figure 4:
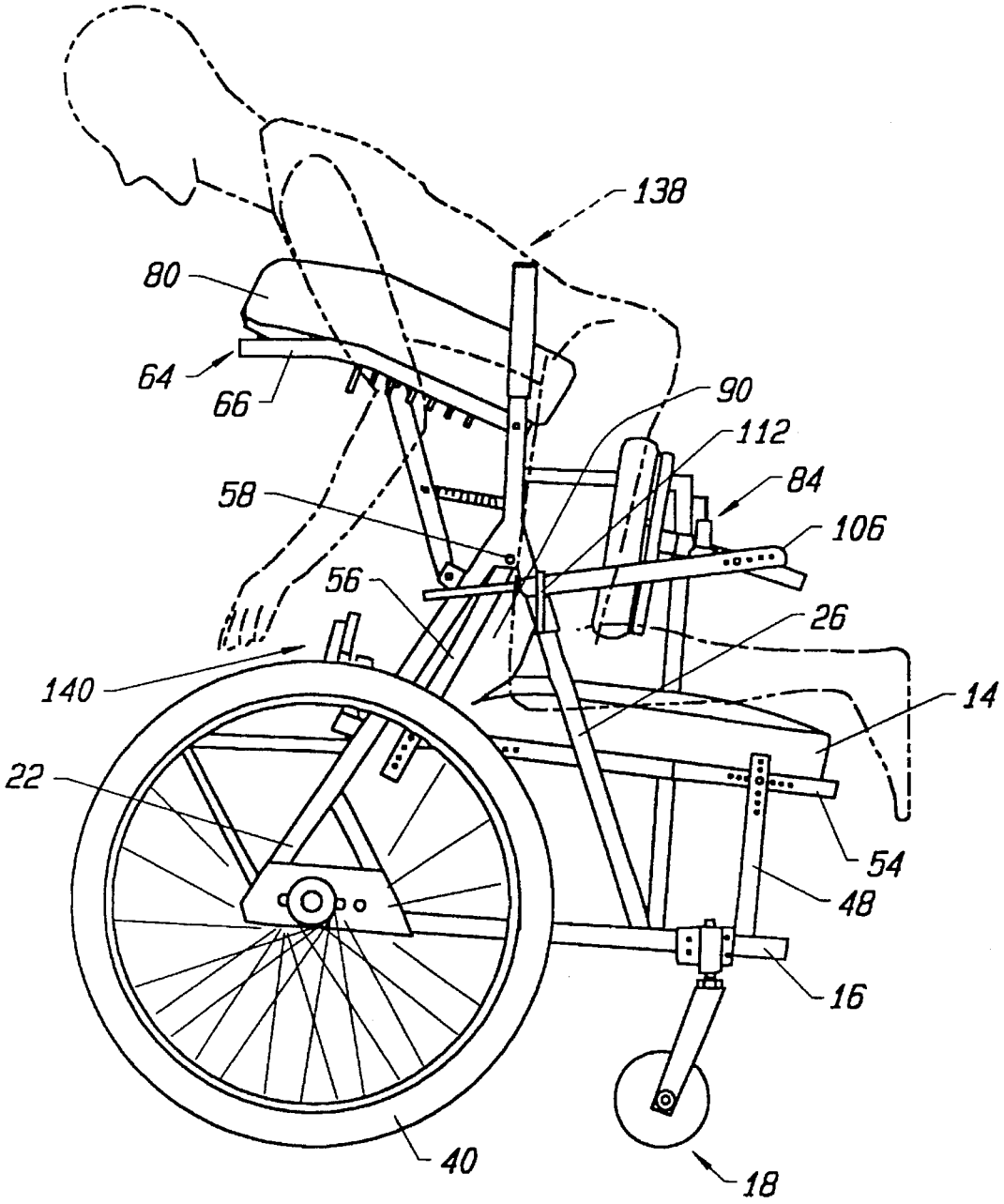
FIG. 4 is a left side elevational view of the vehicle of the present invention with a user of the vehicle depicted in phantom.

Vehicle 10, FIG. 1, includes as one of its elements a base member 12, which is capable of supporting a kneeling pad or surface 14. Base member 12 is constructed with a rectangular frame 16 having a pair of casters 18 and 20 connected thereto. A pair of Y-shaped uprights 22 and 24 are fastened by welding or otherwise to rectangular frame 16 and extend upwardly terminating in posts 26 and 28, respectively. Plates 30 and 32 are welded to rectangular frame 16 and a portion of uprights 22 and 24, respectively. A plurality of openings 34 and 36 of plates 30 and 32 respectively are capable of supporting axles 38 and 39 which support and permit the rotation of large spoked wheels 40 and 42, best shown in FIGS. 1 and 2. Plurality of openings 30 and 32 permit the horizontal adjustment of axles 38 and 39, respectively relative to base member 12. Braces 44 and 46 span upright member 22 and 24, respectively, and rectangular frame 16 to support plates 30 and 32 in the afore-described position. Bars 48 and 50 are fixed to rectangular frame 16 by welding or similar fastening means and adjustably support square tubes 52 and 54 relative to rectangular frame 16, respectively. With reference to FIG. 4, it may be seen that square tube 54 is adjustably fixed to frame member 56 which pivotally attaches to uprights 22 and 24 at pivot pins 58 and 60, FIGS. 2 and 4. Pad 62 is supported by square tubes 52 and 54 is adjustable horizontally and vertically by this arrangement. Pad 62 is employed to support a kneeling user of vehicle 10, which will be described hereinafter in greater detail.

Torso support 64 is also found in the present invention. Torso support 64 includes a plate 66 which includes rows 68 and 70 of outwardly extending pegs, best shown in FIG. 2. Plate 66 is pivotally attached to posts 26 and 28 of uprights 22 and 24 at pivot pins 72 and 74. Rotatable brace 76 rotatably attaches to uprights 22 and 24 and includes an end bar 78 which is capable of lying between adjacent pegs of rows of pegs 68 and 70 and support plate 66 outwardly at a particular angle relative to pad 64. Pad 80 serves to support the torso or chest of the user at this angle when using the vehicle 10. Spring means 84 urges the engagement of end bar 78 with rows of pegs 68 and 70.

Figure 3:
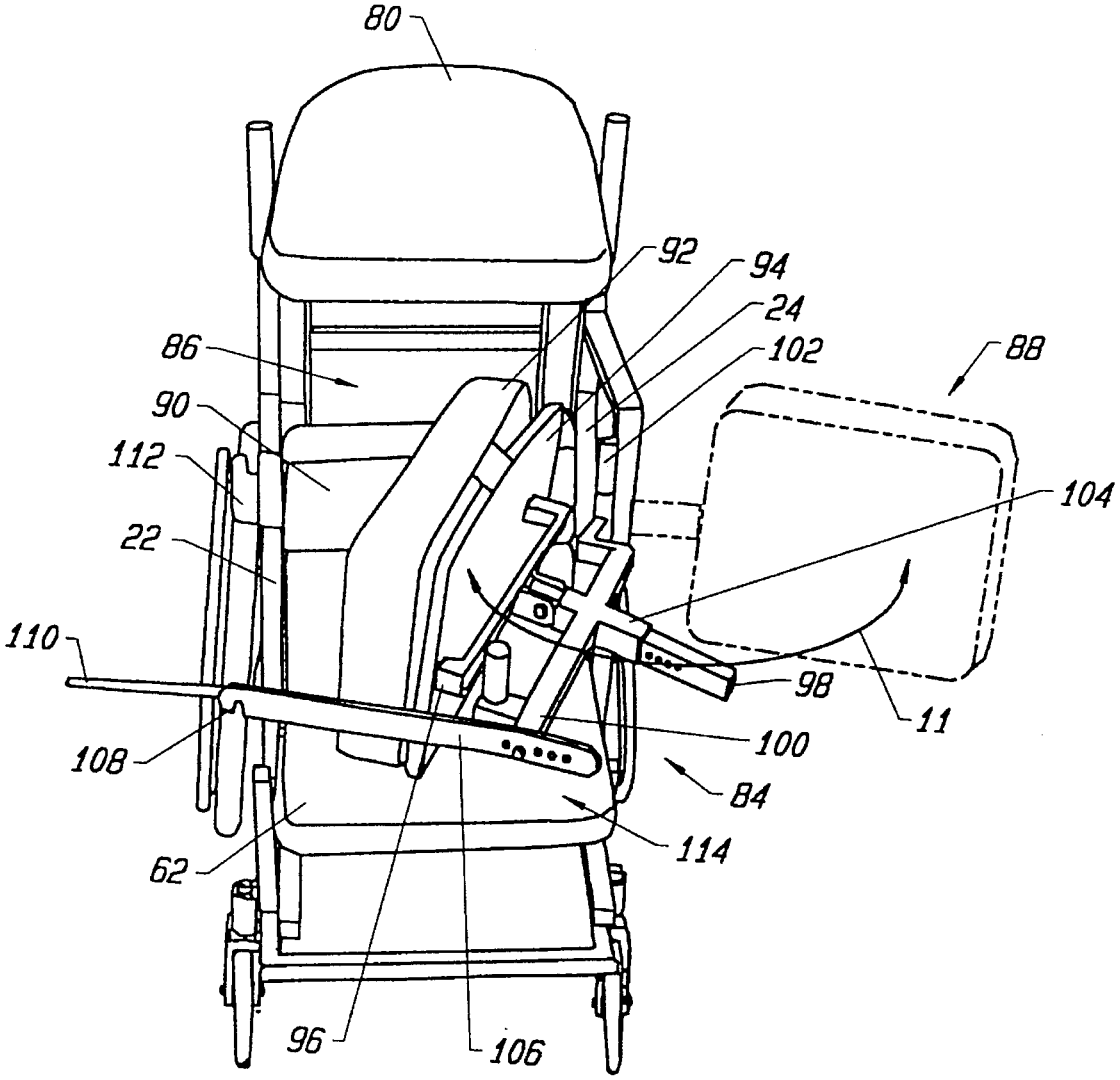
FIG. 3 is a top rear perspective view of the vehicle of the present invention indicating the rotation of the thigh support.

The thigh support 84, FIG. 3, includes a first portion 86 which is stationary and a second portion 88 which is rotatable relative to first portion 86. Interaction of first and second portions 86 and 88 of thigh support 84 constrain the thigh of the user of vehicle 10. First portion 86 includes a cushion 90 which may be a continuation of pad 62 and angle upwardly therefrom. Pad 90 rests against frame member 56 for support. Second rotatable portion 88 of thigh support 84 includes a pad 92 which is fixed to plate 94. Support 96 connects to plate 94 and is rotatable around rod 98, FIGS. 1 and 3. Connecting member 100 terminates in a hinge 102 and includes a central bore 104 which permits the passage of rod 98 therethrough. The position of rod 98 is adjustably determined by plurality of openings 106 through rod 98 and a pin (not shown). The other end of a locking lever 106 rotatably connects to the end of connecting member 100, best revealed in FIGS. 3 and 5. Locking lever 106 includes a notch 108 and a gripping rod 110. Notch 108 is intended to fit in channeled bracket 112 which is fixed to upright 22. Plurality of openings 114 permit the user to adjust the length of locking lever 106 between connecting member 100 and channeled bracket 112. It should be noted that locking lever 106 exhibits a spring tendency outwardly from upright 22. As depicted in FIG. 3, pad 92 and plate 94 swing toward cushion 90 and are held in the position shown in FIG. 1 by the interaction between notch 108 of locking lever 106 and channeled bracket 112. Hinge 102 is supported in the position shown in FIGS. 1, 3, and 5 by angled member 116 which is welded to upright posts 28 and square tube 52.

Figure 2:
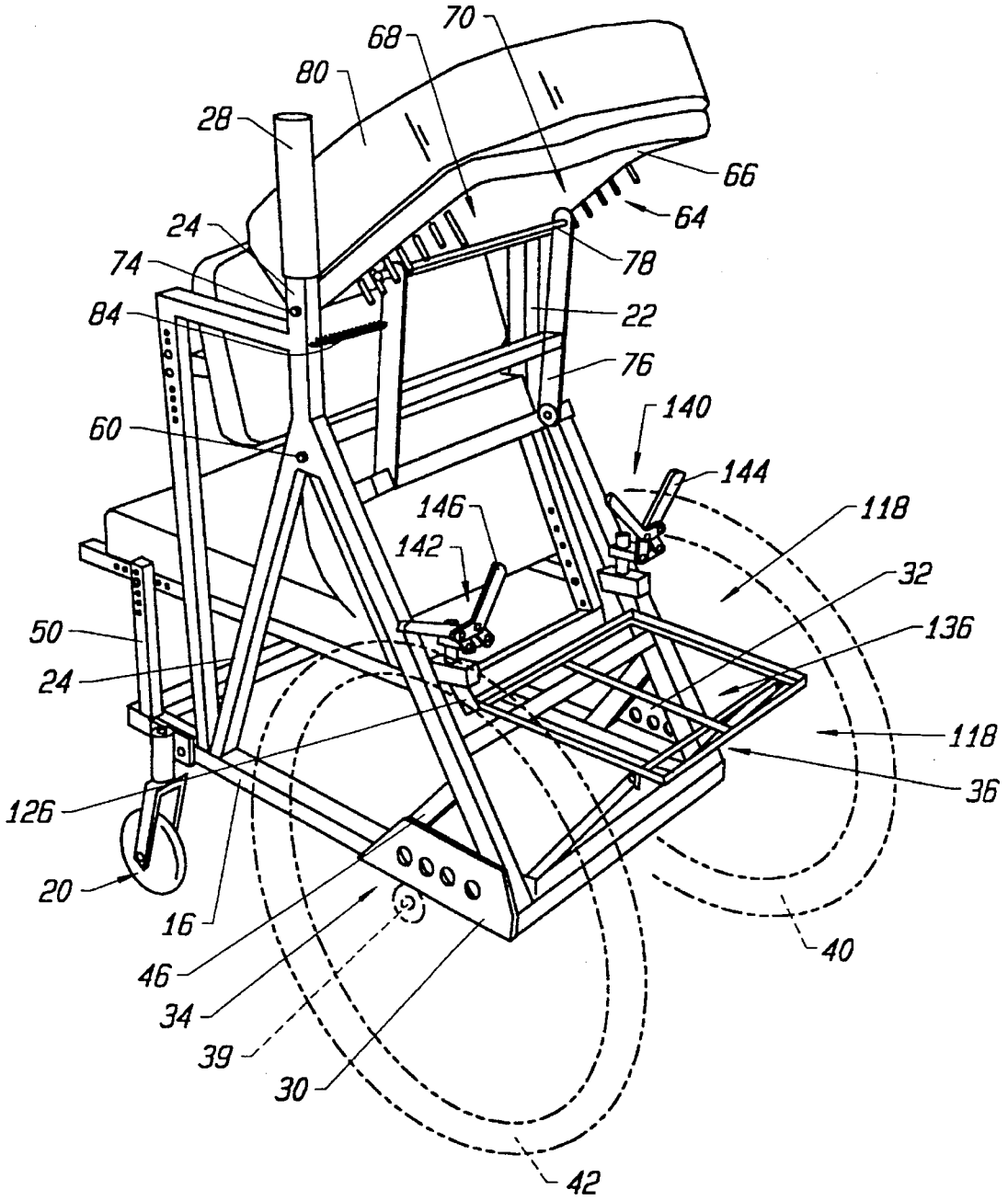
FIG. 2 is a top right perspective view of the vehicle of the present invention showing the pair of front wheels in phantom.
Figure 5:
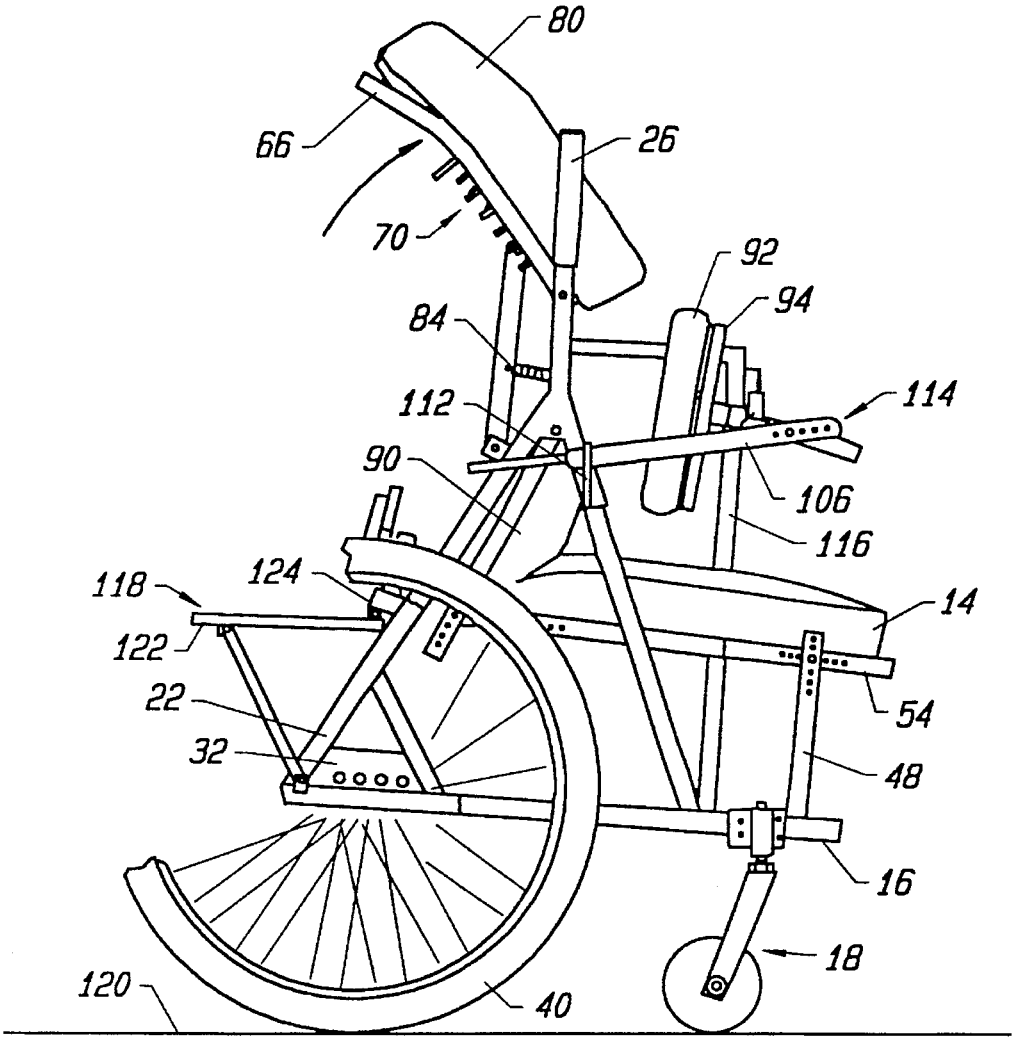
FIG. 5 is a left side perspective view with a cutaway portion of the wheel to reveal the tool support tray feature.
Figure 6:
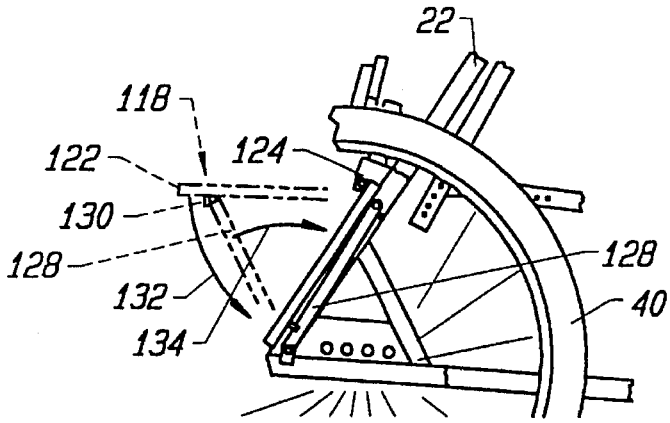
FIG. 6 is a partial side elevational view of the vehicle of the present invention depicting the set-up and storage of the tool tray thereof.

Turning again to FIG. 2 and with reference to FIGS. 5 and 6, vehicle 10 is provided with a tray 118 which extends outwardly from uprights 22 and 24 and lies at a generally horizontal orientation lower to surface 120 than torso support 64. Tray 118 is generally square in plan view and possesses a frame 122 which pivotally attaches to ears 124 and 126, fixed to uprights 22 and 24, respectively. Brace 128 rotatably attaches to uprights 22 and 24 and engages a flange 130 along frame 122 to hold frame 122 in a horizontal position as is depicted in FIGS. 2 and 5. Directional arrows 132 and 134 show the rotational movements of frame 122 and brace 128, respectively. With reference to FIG. 6, it may be observed that brace 128 has been folded against upright 22 and frame 122 has been folded against brace 128 for storage when not in use. It should be observed that frame 122 includes cross members 136, FIG. 2, which permit the supporting of a plate or placard (not shown) to hold items such as tools, machine parts, and the like.

In operation, the user 138, FIG. 4, assumes the kneeling position such that the knees are contacting pad 14 and the front thigh region of the user presses against cushion 90. Torso support 64 permits the user to lean forward on pad 80. Thigh support 84 is swung into position such that first portion 86 and second portion 88 terminating in pads 92 and cushion 90 squeeze or sandwich the thigh region of the user into position. Locking lever 106 is then held into position by the engagement of notch 108 with channeled bracket 112. The user 138 is then free to raise or lower tray 118 and, if desired, engage brace 128 with flange 130 of frame 122 to hold tray 118 in a horizontal position. User 138 in the position shown in FIG. 4 is able to manually grasp wheels 40 and 42 in order to move vehicle 10. Brakes 140 and 142 of conventional configuration may be applied at anytime by turning levers 144 and 146 toward wheels 40 and 42, respectively.

While in the foregoing, embodiments of the present invention have been set forth in considerable detail for the purposes of making a complete disclosure of the invention, it may be apparent to those of skill in the art that numerous changes may be made in such details without departing from the spirit and principles of the invention.

What is claimed is:

1. A vehicle for carrying a disabled person along a surface: comprising:

a. a base member;

b. a torso support linked to said base member and extending outwardly therefrom, said torso support lying above said base member;

c. a thigh support positioned intermediate said base member and said torso support, said thigh support including a first portion and a second portion, said first and second portions being positioned relative to each other and intended for constraining the thigh of the disabled person by sandwiching the thigh of the disabled person between said first and second portions, said first portion extending outwardly from said base member intended to contact the front of the thigh of the disabled person, said second portion being positioned to contact the rear of the thigh of the disabled person and positioned rearwardly on the base with respect to the first portion;

d. a kneeling surface, said kneeling surface being supported by said base member; and e. transporting means linked to said base member for permitting movement of said base member relative to a surface.

2. The vehicle of claim 1 in which said torso support further include means for rotating said torso support relative to said base member.

3. The vehicle of claim 1 in which said transporting means includes an axle extending transversely relative to said base member and a pair of wheels rotatably connected to said axle, said pair of wheels being sized to allow contact of the same by the disabled person.

4. The vehicle of claim 3 in which said transporting means further includes at least one caster spaced from said pair of wheels.

5. The vehicle of claim 1 which additionally comprises a tray linked to said base member and extending outwardly therefrom below said torso support.

6. The vehicle of claim 1 in which said torso support further includes an arm rotatable relative to said base member a pair of uprights, and a platform pivotally connected to said pair of uprights, said platform including a plurality of stops, said rotatable arm being capable of engaging any of said plurality of stops to hold said platform in a particular orientation outwardly relative to said base member.

7. The vehicle of claim 6 which additionally includes a tray extending outwardly from said pair of uprights at a level lower to the surface than said torso support.

8. The thigh support vehicle of claim 1 in which said thigh support second portion includes a rotatable plate and locking means for holding said rotatable plate in a fixed position.

9. The vehicle of claim 8 in which said locking means includes a lever linked to said plate and a fixed member for holding said lever relative to said base member.

10. The vehicle of claim 9 in which said transporting means includes an axle extending transversely relative to said base member and a pair of wheels rotatably connected to said axle, said pair of wheels being sized to allow contact of the same by the disabled person.

11. The vehicle of claim 10 in which said transporting means further includes at least one caster spaced from said pair of wheels.

* * * * *